US005641226A

United States Patent [19]

Jautz, Jr.

[11] Patent Number: 5,641,226

[45] Date of Patent: Jun. 24, 1997

[54] SIGNAL LIGHT COLUMN

[76] Inventor: Karl Jautz, Jr., Urbanstr. 34, D-73207 Plochingen, Germany

[21] Appl. No.: 325,927

[22] Filed: Oct. 18, 1994

[30] Foreign Application Priority Data

Oct. 19, 1993 [DE] Germany ..... 93158548 U

[51] Int. Cl.[6] ..... F21S 1/10

[52] U.S. Cl. ..... 362/363; 362/235; 362/226

[58] Field of Search ..... 362/363, 235, 362/226

[56] References Cited

U.S. PATENT DOCUMENTS 2,121,276 6/1938 Adler, Jr. ..... 362/235
4,587,754 5/1986 Ossner ..... 40/564

FOREIGN PATENT DOCUMENTS 2211801 2/1976 Germany .
7702519 6/1977 Germany .
9010187.1 10/1990 Germany .
WO92/21120 11/1992 WIPO .

*Primary Examiner*—Ira S. Lazarus
*Assistant Examiner*—Alfred Basichas
*Attorney, Agent, or Firm*—Jones, Tullar & Cooper, P.C.

[57] ABSTRACT

A signal light column including a plurality of transparent light sections arranged one above another, and a plurality of inserts situated with one insert in a corresponding light section. The inserts each have a base plate, a socket mounted to the base plate for receiving a lamp, and at least one vertically arranged printed circuit board having at least one electrical strip conductor thereon connected to the base plate and the printed circuit board of the insert situated adjacent its corresponding insert. The light sections are joined together to form a unit as are the inserts. The unit formed of the inserts can be removed as a unit from the unit formed of the light sections.

5 Claims, 4 Drawing Sheets

SIGNAL LIGHT COLUMN

BACKGROUND OF THE INVENTION

1. Field of the Invention

The present invention relates to a column system having separate light sections arranged one above the other and. The column includes transparent housing sections containing inserts fitted with electric conductors which are connected to the conductors arranged in the respective lower insert or in a pedestal element and, in addition, lamp sockets, which are connected to the electrical conductors, are provided in the inserts.

2. Prior Art

Such signal light columns are known. For example, German Patent DE 22 11 801 describes a signal light column in which the separate light sections are individually supplied with electric power via appropriate contact elements.

A column of this type has the following disadvantages: In order to change the lamps, the individual sections have to be disassembled and detached from the overlying section. This is a very cumbersome method. Also, when several lamps have to be replaced at the same time, it is possible for individual light sections or even entire groups of light sections to become mixed up. This can have undesired consequences and risks, especially in industrial applications, because it may result in wrong signals being emitted.

SUMMARY OF THE INVENTION

It is an object of the present invention to eliminate the above disadvantages and, in particular, to simplify the disassembly that is required to replace the lamps. A further object is to reduce the risk of mixing up the color signals when repairs are carried out.

These objects are accomplished by joining the individual inserts together to form a unit and furthermore by joining the individual sections of the housing together so that they also form a unit, and by ensuring that the unit formed by the joined inserts can be removed through the top of the housing.

Such a design considerably simplifies any repair work which needs to be performed on the inserts and when replacing the lamps. Similarly, it avoids the risk of the sequence of colors in the signal light column becoming mixed up.

BRIEF DESCRIPTION OF THE DRAWINGS

One embodiment of the present invention is described below on the basis of the attached drawings, which show.

DESCRIPTION OF THE PREFERRED EMBODIMENT

Figure 1:
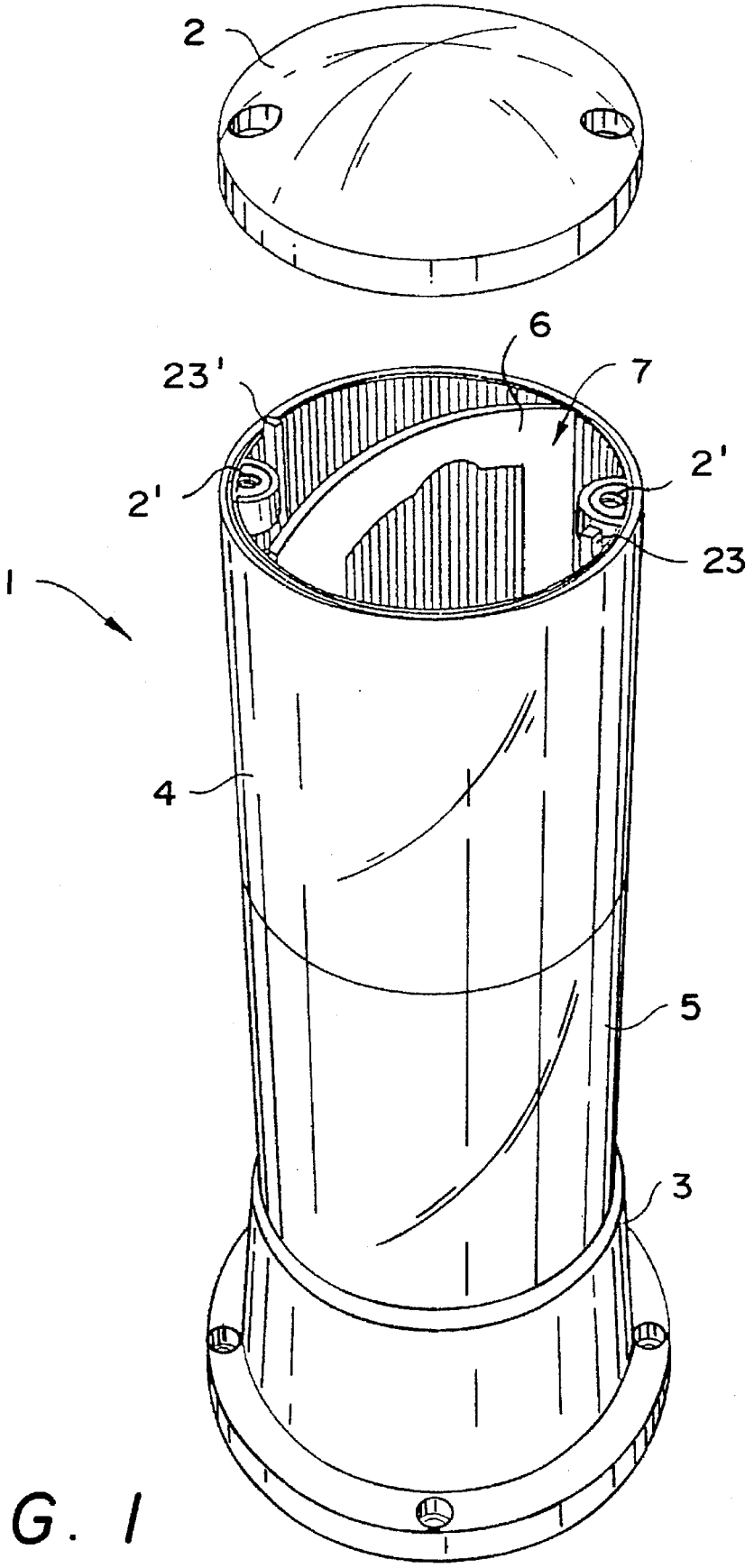
FIG. 1: A perspective view of the signal light column with the cover removed.

FIG. 1 shows a signal light column 1 from which the cover 2 has been unscrewed and removed. The fastening screws (not shown) are inserted through the cover 2 into appropriate attachment lugs 2' provided in the upper housing section 4. Two hollow, cylindrical housing sections 4, 5, made of transparent colored (e.g. green, red) plastic material, are arranged one on top of the other on a pedestal section 3 which is connected to a power supply and is equipped with appropriate electrical power distribution devices. The upper housing section 4 is connected to the lower housing section 5, and the lower housing section 5 is connected to the pedestal 3 by means of screws (not shown) which engage in appropriate attachment lugs (as at 2'). The connection can also be made by means of an appropriate geometrical design or by using adhesive. The housing sections 4, 5 are firmly, but detachably, connected to each other and form the housing of the lights. It is possible to arrange any desired number of housing sections 4, 5 one above the other. Part of a curved cross-piece 6 of an upper insert 7 is visible inside the upper housing section 4 in FIG. 1.

Figure 2:
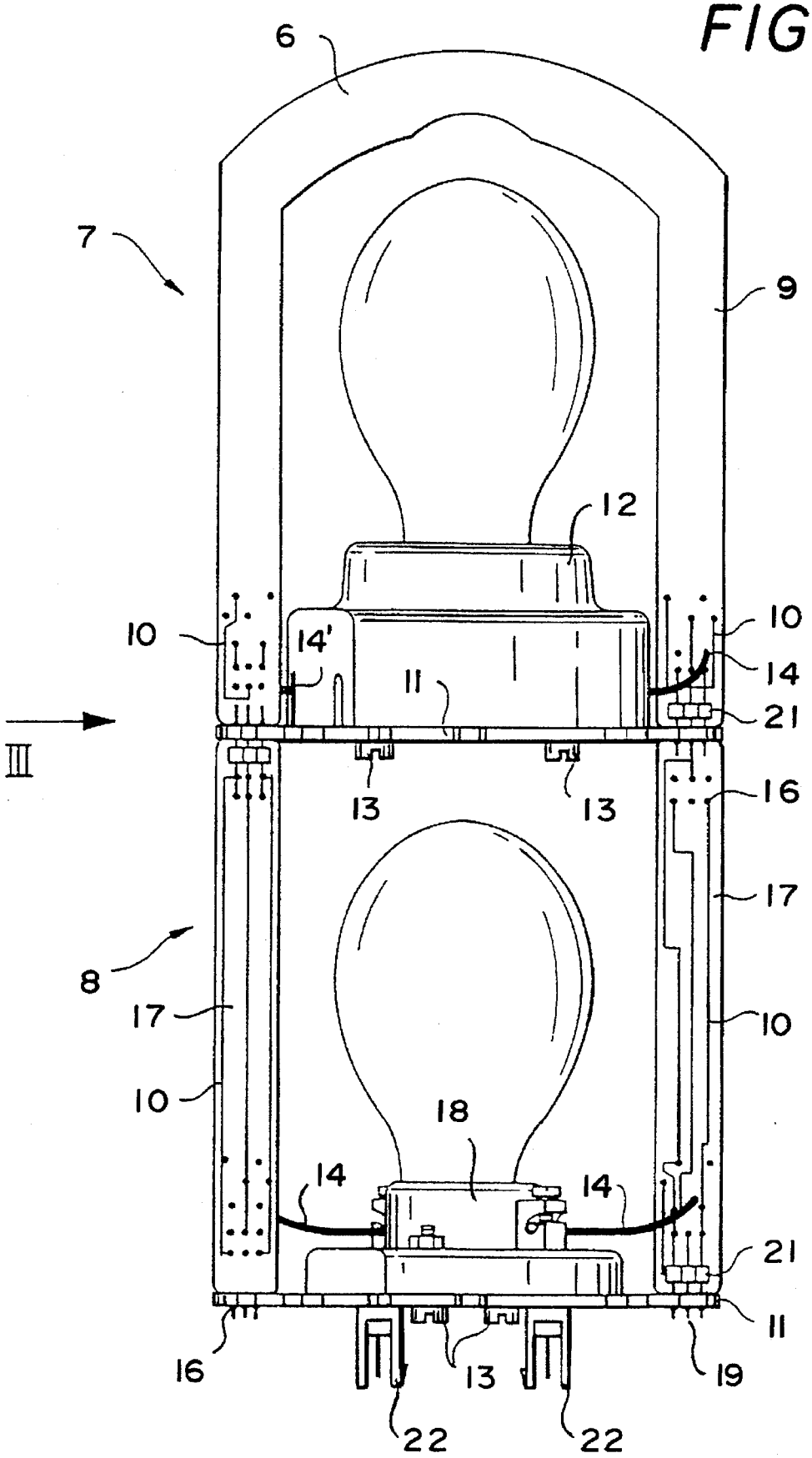
FIG. 2: An insert unit, consisting of two individual inserts from the signal light column illustrated in FIG. 1.
Figure 3:
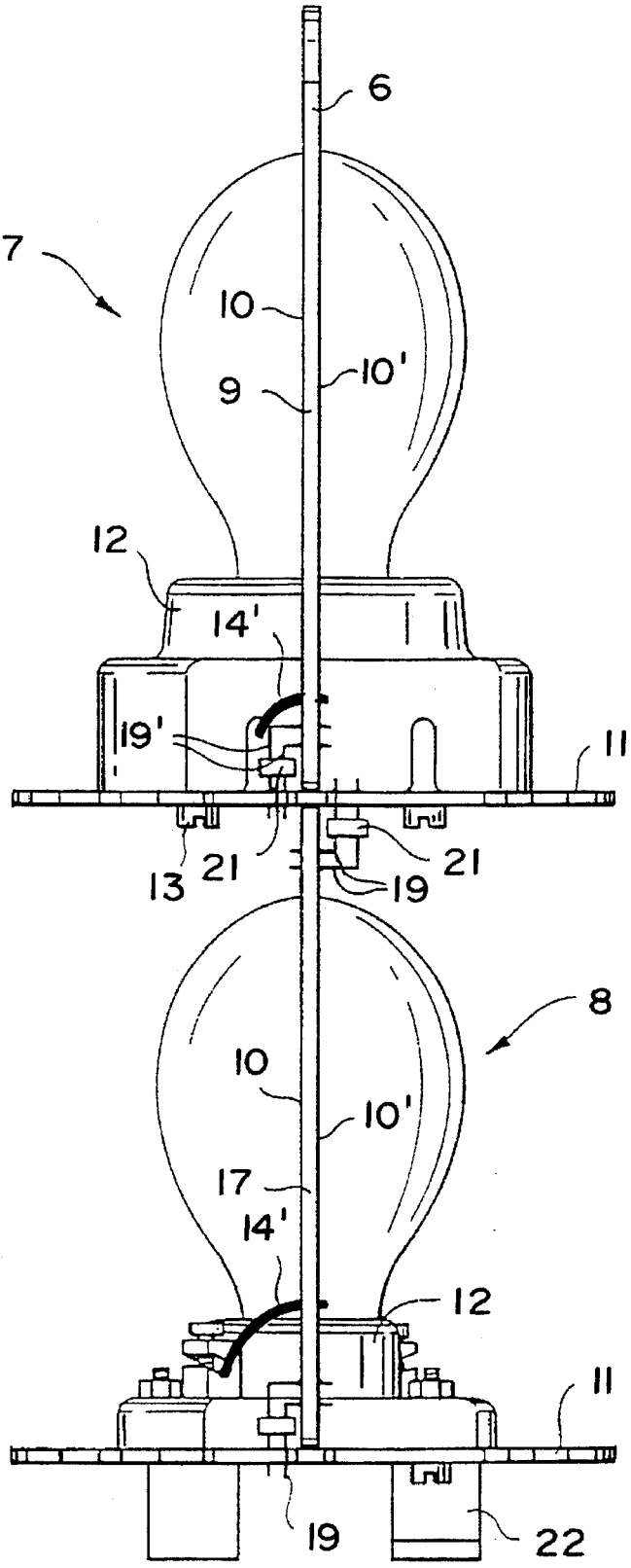
FIG. 3: A view in the direction Indicated by the arrows III—III in FIG. 2.

An insert is arranged in each housing section 4, 5. The individual inserts 7, 8 of the signal light column 1 are shown in FIGS. 2 and 3. The individual inserts 7, 8 are also firmly connected with one another to form an insert unit which can be grasped by the curved cross-piece 6 and removed in its entirety without having to disassemble the housing. The upper insert 7 consists of a printed circuit board 9 (into which the curved cross-piece 6 is integrated) having strip conductors 10, a base plate 11 and a socket 12 for a lamp. Other types of lamp with appropriate sockets may also be fitted. The lamp socket 12 is attached to the base plate 11 by means of attachment screws 13. The strip conductors 10, 10' and the 10' connecting cables 14, 14' of the lamp socket 12 are electrically connected by soldering.

The lower insert 8 consists of two printed circuit boards 17 on which strip conductors 10, 10' are also provided. The lower lamp socket 18 is attached to the lower base plate 11 by means of attachment screws 13. Again, the connecting cables 14, 14' are electrically connected with the strip conductors 10, 10' by soldering.

The mechanical connection of the individual inserts 7, 8, and the electrical connection of the strip conductors 10, 10' on the printed circuit boards 9, 17, is accomplished by means of right-angled pins 19, 19' which are mounted in insulating elements 21. These pins are soldered at one end to the strip conductors of a printed circuit board and at the other end they are soldered to the strip conductors in the base plate 11. For example, in FIG. 3 the strip conductor 10 (seen on the left-hand side in FIG. 2), which is located on the left-hand side of the printed circuit board 9, is connected to the pins 19'; these pins, in turn, are connected to one set of ends of the strip conductors 30 on the base plate 11 (see FIG. 4), while the other set of ends of the strip conductors 30 are connected to the pins 19 (FIG. 3), and these in turn are connected to the strip conductors 10' on the right-hand side of the printed circuit board 17. The connections are made in a similar manner on the right-hand side in FIG. 2. On the underside of its base plate 11, the lower insert 8 is provided with two electrical plugs 22, which engage in appropriate sockets (not shown) in the pedestal 3. This type of plug connection ensures not only electrical but also mechanical contact. Both contacts are broken when the insert unit is removed from the housing.

The insert unit formed by joining all the individual inserts 7, 8 together with one another is removed from the housing by pulling on the curved cross-piece 6. When more than two inserts 7, 8 are provided, a curved cross-piece 6, integrated with the printed circuit boards, is included in the uppermost insert. The insert unit is returned to the housing in corresponding fashion.

Figure 4:
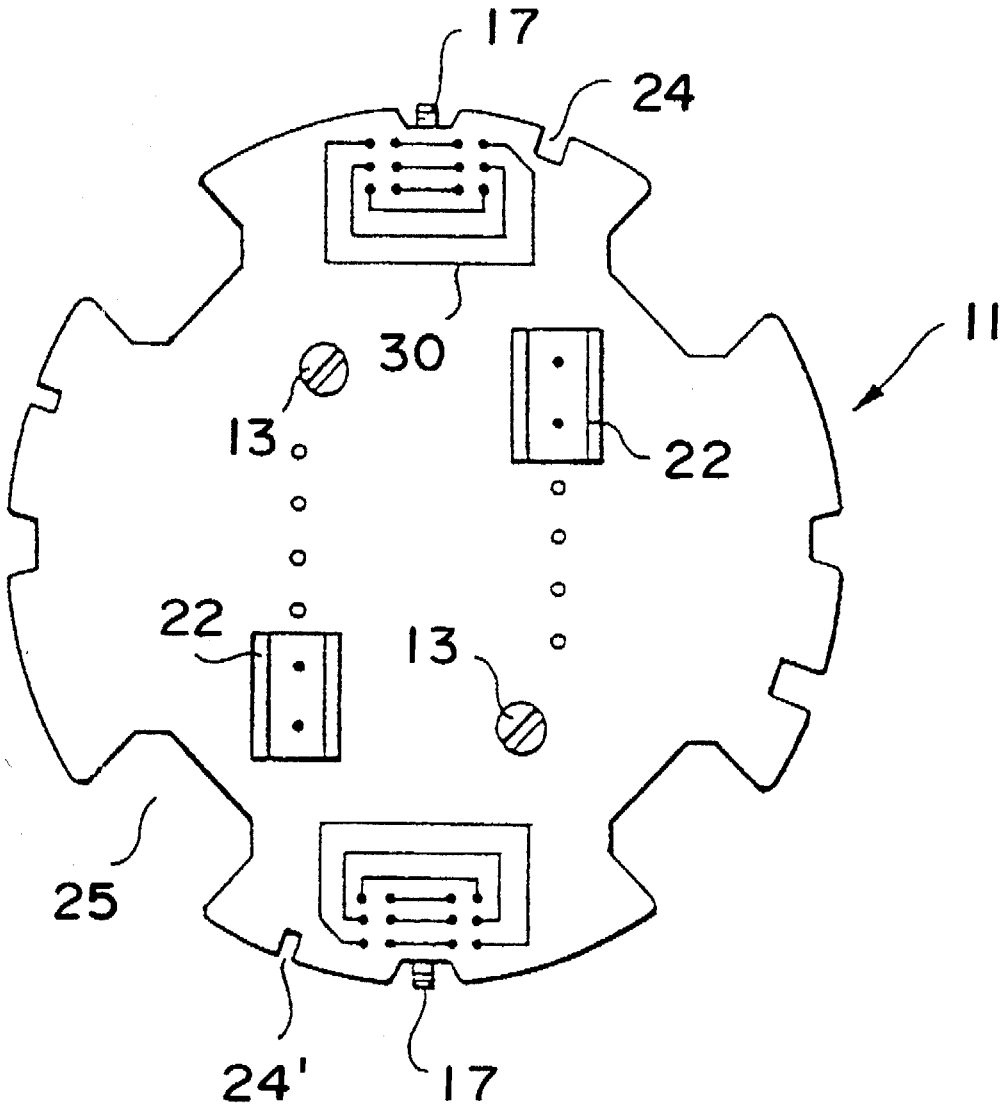
FIG. 4: The underside of the base plate 11 of the lower insert 8.

In order to fit the insert unit more easily into the housing formed by the housing sections, the housing sections 4, 5 possess projecting ribs 23, 23' which fit into positioning notches 24, 24' on the base plates 11 (FIGS. 1 and 4). So that the inserts can be fitted in only one position, the projecting ribs 23 and 23' and the positioning notches 24 and 24' are different in width. The large recesses 25 are provided so that, as the insert unit is installed, it can clear the attachment lugs 2'.

As an alternative to this guidance method, the printed circuit board 17 can be designed to run on both sides in guide grooves arranged opposite each other on the inside of the housing sections 4 and 5. In order to permit the insert unit to be fitted in only one position, it is merely necessary to provide one further rib 23 which fits in a positioning notch 24.

Guiding and fixing the position of the insert unit within the housing can also be accomplished in other ways, i.e. by cooperation between other projections and grooves in the respective parts.

I claim:

1. A signal light column, comprising:

a plurality of transparent light sections arranged one above another, each light section forming part of a housing defining a top; and a plurality of inserts situated with one insert in a corresponding light section, each said insert having a base plate, a socket mounted to said base plate for receiving a lamp, and at least one vertically arranged printed circuit board mounted on said base plate, each printed circuit board having at least one electrical strip conductor thereon electrically connected to said socket and to the electrical strip conductor of the printed circuit board of said insert situated adjacent its corresponding insert, wherein:

said light sections are joined together to form a unit, and said inserts are joined together to form a unit, with the unit formed by said plurality of inserts being removable as a unit through the top of the housing.

2. The signal light column as defined in claim 1, wherein the uppermost insert includes two printed circuit boards and a curved cross-piece connecting the two printed circuit boards.

3. The signal light column as defined in claim 1, further comprising:

at least one plug extends from the lowermost insert, each plug being connected to a strip conductor of the lowermost insert; and a pedestal section to which the lowermost light section is connected, said pedestal section housing a power supply to which each plug is connected, wherein:

electrical contact with the power supply is broken by the withdrawal of each plug when the inserts are removed as a unit from said light sections.

4. The signal light column as defined in claim 1, further comprising:

at least one strip conductor mounted on each base plate; and a pin connected to each strip conductor on a printed circuit board to a strip conductor on its respective base plate, thereby effecting connection of individual inserts.

5. The signal light column as defined in claim 4, wherein the pins are connected to the strip conductors by soldering.

* * * * *